United States Patent [19]

Karpinski

[11] Patent Number: 4,860,398

[45] Date of Patent: Aug. 29, 1989

[54] ROD AND BRACKET ASSEMBLY AND ASSOCIATED BED SKIRT

[76] Inventor: Vivian L. Karpinski, 2511 Madison St., New Port Richie, Fla. 34652

[21] Appl. No.: 177,361

[22] Filed: Apr. 4, 1988

[51] Int. Cl.[4] ..... A47C 21/00

[52] U.S. Cl. ..... 5/493; 5/498; 5/508; 24/72.5; 24/462

[58] Field of Search ..... 5/493, 498, 496, 508; 24/72.5, 462; 160/350

[56] References Cited

U.S. PATENT DOCUMENTS

| | | | |
|---|---|---|---|
| 959,763 | 5/1910 | Lehr | 5/498 |
| 2,769,989 | 4/1956 | Woodford | 5/498 |
| 4,100,632 | 7/1978 | Johnson | 5/498 |
| 4,716,608 | 1/1988 | Whitfield | 5/498 |

FOREIGN PATENT DOCUMENTS

| | | | |
|---|---|---|---|
| 8719 | of 1892 | United Kingdom | 5/493 |
| 12142 | of 1902 | United Kingdom | 5/493 |
| 14213 | of 1912 | United Kingdom | 5/493 |

*Primary Examiner*—Alexander Grosz

*Attorney, Agent, or Firm*—Dominik, Stein, Saccocio, Reese, Colitz & Van Der Wall

[57] ABSTRACT

An improved bed skirt assembly including a plurality of laterally spaced apart brackets coupled to the bottom of a box spring frame of a bed. The assembly also including rods placed into and supported by the brackets to accommodate prepared yard good material having a casing at the top end. The yard good material is shirred to enable the user to create a ruffled bed skirt using a minimum of sewing effort and without removal of the mattress from the bed during installing and removing of the yard good material.

12 Claims, 2 Drawing Sheets

FIG. 1
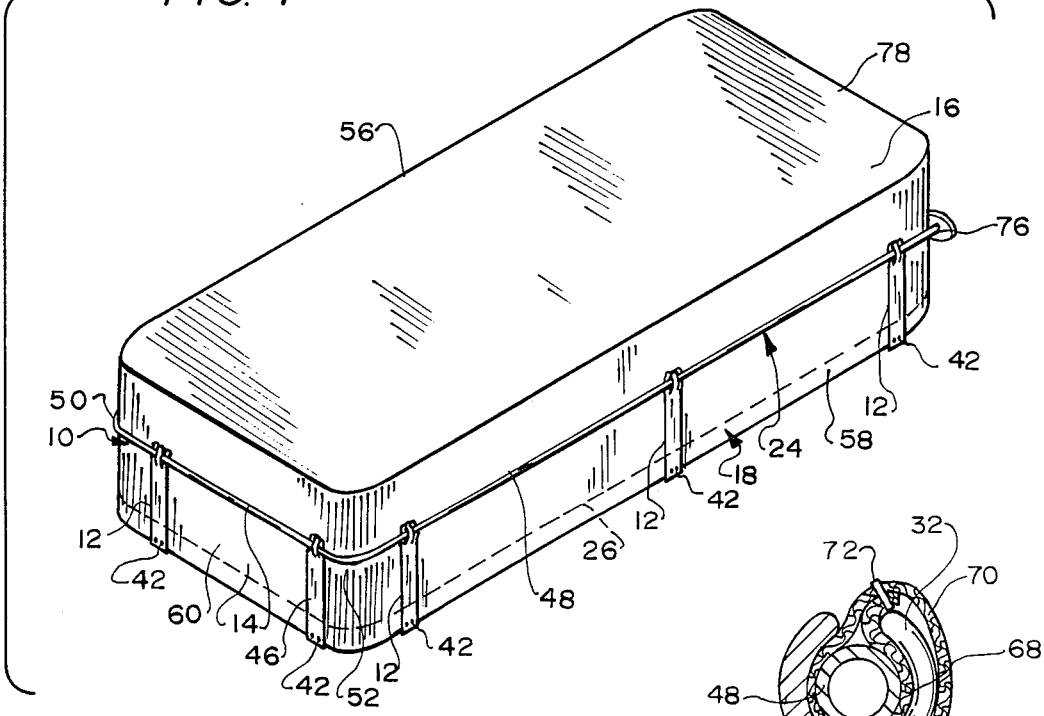
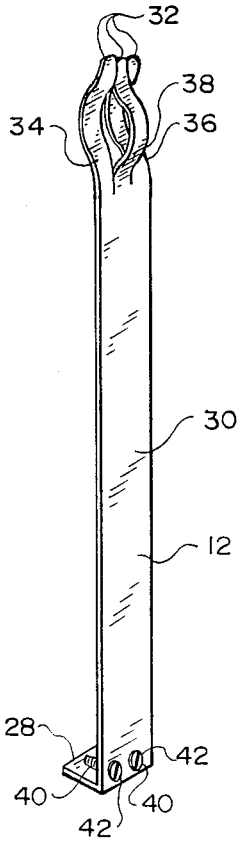
FIG. 2
FIG. 3
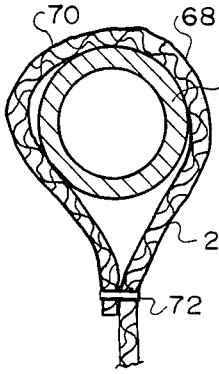
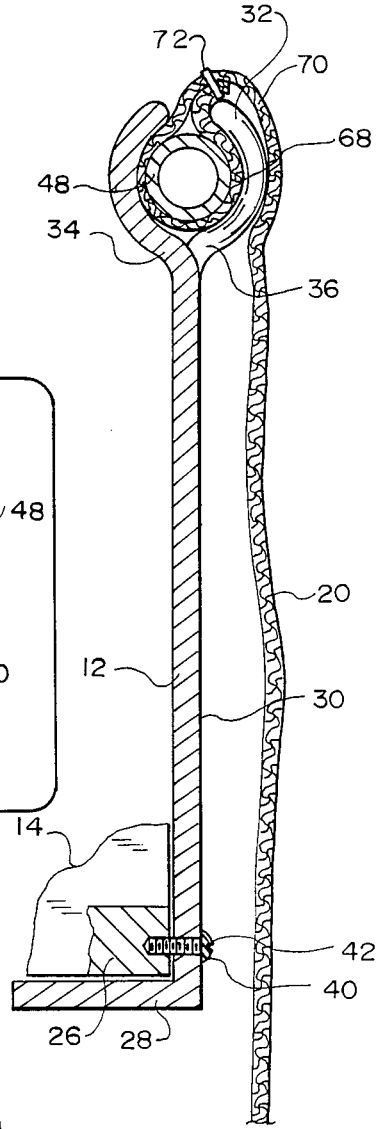
FIG. 4

ROD AND BRACKET ASSEMBLY AND ASSOCIATED BED SKIRT

BACKGROUND OF THE INVENTION

This invention relates to rod and bracket assemblies for bed skirts often called dust ruffles and, more particularly, to a box spring, a bed skirt and a rod and bracket assembly having a plurality of vertically extending, laterally spaced brackets coupled to the bottom of the box spring with horizontally extending rods placed into and retained by the brackets to support the bed skirt.

DESCRIPTION OF THE BACKGROUND ART

In the field of bed skirts and their supporting hardware, it is the common practice to position a flat sheet-like member or platform beneath a mattress and above a box spring supported on slats of a bed frame. The platform is of a size to be peripherally co-extensive with the box spring and mattress. From the two sides and foot end of the platform, cloth depends in a color and fabric coordinated with other parts of the bedding or room. The depending fabric preferably includes tucks or shirring permanently stitched to the platform. Because of its extensive size and shirring, the stitching of the depending cloth to the platform is a burdensome task.

In addition to fabrication problems, the placement of a skirt in position between a box spring and mattress and its removal, whether for cleaning or replacement purposes, is also difficult, a two-person job requiring the removal of the mattress from the box spring and its replacement. Consequently, skirt cleaning or changing is done less frequently than it should be. Further, any unnecessary movement of the box spring or mattress, as during sleeping or making the bed, may laterally displace the previously positioned platform to render the hem of the skirt uneven requiring, in turn, readjustment of the skirt.

The prior art discloses a large number of techniques for holding a bed skirt in place. Consider British Pat. Nos. 13,369 to Brownlow and 20,213 to Cluskey as well as U.S. Pat. No. 710,477 to Littell. These patents disclose bed skirts supported on rods secured to a metallic frame in an older form of bed wherein the frame is located at the bottom of the box spring location. Further, U.S. Pat. Nos. 264,758 to Richardson and 674,609 to Higley disclose complex mechanisms for supporting a removable bed skirt with such mechanisms including a plurality of parts connectable to the bed frame members. Lastly, U.S. Pat. Nos. 210,084 to Blake and 4,228,980 to Beauchamp disclose bracket arrangements for supporting cloth material depending therefrom but for use in the curtain arts rather than the bedding arts.

As illustrated in a great number of prior patents as well as commercial devices, efforts are continuously being made in an attempt to improve bed skirts and their associated hardware whereby yard good material may be conveniently placed and removed from adjacent to the lower portions of beds. None of these previous efforts, however, provides the benefits attendant with the present invention. Additionally, prior art dust ruffles do not suggest the present inventive combination of component elements arranged and configured as disclosed and claimed herein. The present invention achieves its intended purposes, objectives and advantages over the prior art devices through a new, useful and unobvious combination of component elements, with the use of a minimum number of functioning parts, at a reasonable cost to fabricate, and by employing only readily available materials.

Therefore, it is an object of the present invention to provide an improved combination including a box spring upon which is to be supported a mattress over which bedding is to be placed. A rod and bracket assembly is secured to the box spring. This assembly includes rods and a plurality of brackets which are secured to the box spring adjacent to the lower extents, projecting upwardly and terminating in resilient fingers that are a size which will allow receipt of the rods around the opposite sides and bottom end of the box spring. The combination also includes a bed skirt which has a casing stitched in its upper end received on the rod means.

It is another object of this invention to secure brackets and rods with respect to a box spring and mattress to allow for the convenient placement and removal of bed skirts.

It is a further object of the instant invention to simplify the fabrication of shirred dust ruffles.

Lastly, it is an object of the subject invention to retain bed skirts in proper orientation with respect to beds regardless of movement of the beds.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an improved combination including a box spring upon which is to be supported a mattress over which bedding is to be placed. A rod and bracket assembly is secured to the box spring. This assembly includes rods and a plurality of brackets which are secured to the box spring adjacent to the lower extents, projecting upwardly and terminating in resilient fingers that are a size which will allow receipt of the rods around the opposite sides and bottom end of the box spring. The combination also includes a bed skirt which has means at its upper end for coupling the bed skirt to the rod means.

The plurality of brackets project upwardly to about the top of the box spring. The bed skirt extends downwardly from the rods a distance equal to the thickness of the box spring plus the height of the box spring from the floor therebetween. The rods are coupled with respect to each other in a U-shaped configuration for being located along the sides and bottom edge of the box spring and are separable with respect to each other to thereby allow rods of different sizes to be coupled with respect to each other to accommodate their use in association with box springs of different sizes. Stoppers are removably positioned on the ends of the rods adjacent the head end of the box spring to preclude inadvertent removal of the bed skirt from the rods.

In addition, for the purpose of summarizing the invention, the invention may also be incorporated into an improved dust ruffle comprising, in combination a quantity of yard good material having a casing at its upper edge, a plurality of brackets having resilient fingers at their upper ends and attachable at their lower ends to the frame at the lower edge of a box spring and supporting rods removably received in the resilient fingers of the brackets receiving the casing of the material.

The casing is formed by stitches along the upper free end of the yard good material and along a line of the yard good material thereadjacent. The resilient fingers extend upwardly to allow the rods to be supported therein by gravity and the resilience of the fingers, but the resilience of the fingers allows the removal of the rods from the brackets by lifting the rods upwardly against gravity and the resilient retaining force of the fingers. The yard good material hangs from the rods along the major extent of the rods but depends from the upper ends of the fingers at locations adjacent the fingers.

Lastly, for the purpose of summarizing the invention, the invention may be incorporated into improved hardware for being secured to the lower edge of a box spring and for supporting a bed skirt. The hardware which includes generally horizontally disposed rod means constituting the upper extent of the hardware and generally vertically disposed bracket means having means at their lower ends for coupling to the box spring, such bracket means also having means at their upper ends for removably receiving and supporting the rod means.

Each bracket means includes a vertical section positionable flush with the lower surface of the box spring and a vertical section positionable flush with a vertical surface of the box spring. The hardware further includes aperture means in the vertical face of the bracket means adjacent the lower extents thereof. The upper extents of the bracket means are formed as a plurality of resilient fingers in opposed relationship and presenting a generally circular cross-sectional shape conforming with the cross-sectional shape of the rod means. The fingers are in opposed interleafed relationship.

The foregoing has outlined rather broadly the more pertinent and important features of the present invention in order that the detailed description of the invention that follows may be better understood so that the present contribution to the art may be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 1 is a perspective illustration of a box spring and mattress provided with the bracket and rod assembly for supporting a bed skirt constructed in accordance with the principles of the present invention.

FIG. 2 is a perspective illustration of one of the rod supporting brackets as shown in FIG. 1.

FIG. 3 is a sectional view of one rod as shown in FIG. 1 and also including a portion of the bed skirt positioned on the rod.

FIG. 4 is a sectional view of one rod and supporting bracket as shown in FIG. 1 and also including a portion of the bed skirt positioned on the rod.

Similar referenced characters refer to similar parts throughout the several Figures.

DETAILED DESCRIPTION OF THE INVENTION

Figure 5:
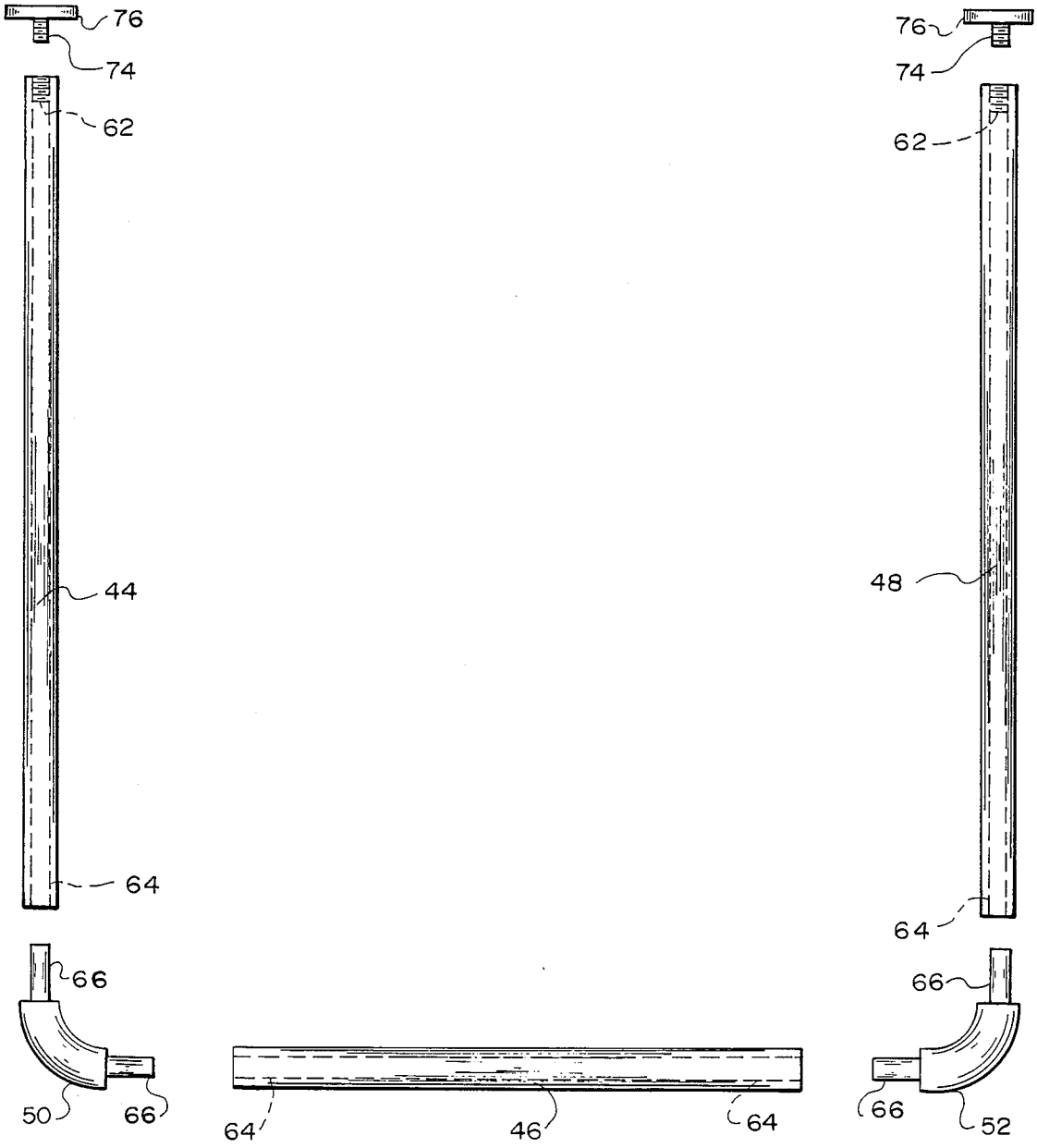
FIG. 5 is a plan view of the rod assembly as shown in FIGS. 1, 2, 3 and 4.

With reference to FIG. 1, the present invention is shown as a kit of rods 10 and a plurality of associated brackets 12 in combination with a box spring 14 and mattress 16 of a bed 18. FIGS. 3 and 4 illustrate yard good material 20 operatively coupled therewith. The rod and bracket assembly 24 is attached to a wooden frame 26 in the lower portion of the box spring 14 and supports in proper position the yard good material 20 as a bed skirt, often called a dust ruffle.

As can be clearly seen in the drawings, each bracket 12 comprises a flat horizontally positionable base 28 coupled to a flat vertically positionable face 30 which terminates in upwardly extending free ends 32. The free ends 32 include a plurality of fingers or prongs 34, 36 and 38, three in the disclosed embodiment, shaped to form grooves in a generally circular shape. The prongs 34, 36 and 38 are upwardly directed and resilient for releasably supporting the rods 10 of a kit. As can be seen in FIG. 2, the upwardly extending fingers 34, 36 and 38 are in an interleafed relationship with two spaced fingers 34 and 38 adjacent the box spring 14 and one central finger 36 on the opposite side thereof. Holes 40 at the bottom of the vertical face 30 of each bracket 12 accommodate screws 42 for securement into the wooden frame 26 normally found at the lower portion of modern box springs 14. The horizontal base 28 of each bracket 12 is set flush under the box spring 14 with the back of its vertical face 30 flush with the side of the box spring 14 so that the bracket 12 extends upwardly in contact with the box spring 14. The upper ends 32 of the brackets 12 terminate along side the top of the box spring 14 adjacent to the bottom of the mattress 16.

An adjustable rod kit 10 is made up of three straight rods or tubes 44, 46 and 48 coupled together by two curved solid rods 50 and 52 which adjust to fit around both sides 56 and 58 and the foot end 60 of the box spring 14. The tubes 44, 46 and 48 and adapted to receive the ends of the rods 50 and 52 which are formed with ends 66 of a reduced diameter for being received in mating relationship with the ends of tubes 44, 46 and 48. The ends 66, which are preferably turned down to proper size, are inserted into the unthreaded ends 64 of the tubes to form a horizontal U-shaped support structure for yard good material 20. Adjustment of the rods is effected by the inserting of the ends of the curved rods into the tubes to different distances thereby allowing for varying the size of the U-shaped structure.

It should be understood that the use of rods with turned down ends in association with tubes, as disclosed herein, coupling the various component segments of the rod assembly, in addition to providing adjustability, also allows for the use of different sized rods in combination with each other. This allows appropriate rods to be selected to accommodate different sizes of box springs, single, double, king, queen, etc. without buying an entirely new rod kit.

The upward positioning of the fingers of the brackets is such that the force of gravity will support the rods in proper position within the brackets adjacent the upper edge of the box spring. In addition, by constructing the fingers resilient and partially circular in shape, conforming to the cross-sectional shape of the rods, the resilience of the fingers will further retain the rods in proper position. The resilience of the fingers is such, however, that upward movement of the rods will effect separation of the fingers and allow for the removal of the rods for removing the rods from the brackets for their replacement therein.

The visible part of the bed skirt or dust ruffle is the yard good material 20 adapted to be supported on the tubes and rods which together couple to form the U-shaped assembly of a common cross-sectional diameter. The material is of a length equal to, but preferably greater than, the lengths of the tubes and solid rods when coupled together and supported by the brackets. By constructing the material of the greater length, up to fifty percent (50%) greater than the length of the U-shaped structure in the preferred mode, the material may be evenly gathered together along its length to form tucks or a shirred effect which is more pleasing in appearance.

A loop or casing 68 is formed into the upper edge 70 of the yard good material by a line of stitching 72. The casing is of such size as to easily receive the tubes and rods. This size relationship allows for the shirring of the bed skirt as well as the receipt of the tubes and rods and material into the resilient free ends 32 at the upper edges of the brackets 12.

As can be seen with particular reference to FIG. 3, the yard good material hangs from the rods for the majority of the extent of the material. In the region of the brackets, however, the fabric supported on the rods will be tucked into the region within the fingers of the brackets and will, thereby, depend from the top of the brackets. When sufficient material is utilized and shirred, no noticeable raising of the fabric adjacent the brackets will be visible to detract from the preferred appearance of the bed skirt.

The length of the material hanging from the tubes and rods is preferably of a length equal to the thickness of the box spring plus the height of the box spring above the floor. In this manner the material will effectively hide the box spring and area therebeneath the entire way to the floor. The height of the material is such that when standard bedding, in the nature of sheets or a color-coordinated comforter, is placed on the bed, the lower edges thereof will slightly overlap the material of the bed skirt to present a layered look for optimum appearance.

When the bed skirt has been installed on the rod kit and the rod kit has been snapped onto the brackets, the threaded ends 74 of the stoppers 76 are screwed into the threaded ends 62 of the straight tubes at the head end 78 of the box spring and mattress to prevent the bed skirt from slipping off the ends of the rod. Thus it can be seen that the bed skirt rod assembly, whether it is made of wood, metal, plastic or any other suitable material or combination of materials, provides a simple and effective device for mounting preselected yard good material thereon resulting in a bed skirt or dust ruffle which is simple to fabricate, which always retains its position and which is easy to remove and replace.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. In combination:

a box which is to be supported a mattress and over which bedding is to be placed;

a rod and bracket assembly secured to the box spring, such rod and bracket assembly including rods, such rod and bracket assembly also including a plurality of brackets secured to the box spring adjacent to their lower extents and projecting upwardly and terminating in resilient fingers of a size as to receive the rods around the opposite sides and bottom end of the box spring, and a bed skirt having means at its upper end for coupling the bed skirt to the rod means.

2. The combination as set forth in claim 1 wherein the plurality of brackets project upwardly to about the top of the box spring.

3. The combination as set forth in claim 2 wherein the bed skirt extends downwardly from the rods a distance equal to the thickness of the box spring plus the height of the box spring from the floor therebeneath.

4. The combination as set forth in claim 3 wherein the rods are coupled with respect to each other in a U-shaped configuration for being located along the sides and bottom edge of the box spring and are separable with respect to each other to thereby allow rods of different sizes to be coupled with respect to each other to accommodate their use in association with box springs of different sizes.

5. The combination as set forth in claim 4 and further including stoppers removably positioned on the ends of the rods adjacent the head end of the box spring to preclude inadvertent removal of the bed skirt from the rods.

6. An improved dust ruffle comprising, in combination:

a quantity of yard good material having a casing at its upper edge;

a plurality of brackets having resilient fingers at their upper ends and attachable at their lower ends to the frame at the lower edge of a box spring; and supporting rods removably received in the resilient fingers of the brackets receiving the casing of the material.

7. The dust ruffle as set forth in claim 6 wherein the casing is formed by stitches along the upper free end of the yard good material and along a line of the yard good material thereadjacent.

8. The dust ruffle as set forth in claim 7 wherein the resilient fingers extend upwardly to allow the rods to be supported therein by gravity and the resilience of the fingers but the resilience of the fingers allows the removal of the rods from the brackets by lifting the rods upwardly against gravity and the resilient retaining force of the fingers.

9. The dust ruffle as set forth in claim 8 wherein the yard good material hangs from the rods along the major extent of the rods but depends from the upper ends of the fingers at locations adjacent the fingers.

10. Hardware for being secured to the lower edge of a box spring and for supporting a bed skirt, the hardware including:

a plurality of generally horizontally disposed rod means constituting the upper extent of the hardware each rod means positionable along one edge of a box spring; and a plurality of generally vertically disposed bracket means, each comprising a vertical section positionable flush with a vertical surface of the box spring and having aperture means in their lower ends for effecting their coupling to the box spring, wherein the upper extends of the bracket means are formed as a plurality of resilient fingers in opposed relationship and presenting a generally circular cross-sectional shape conforming with the cross-sectional shape of the rod means to be removably supported thereby.

11. The hardware as set forth in claim 10 wherein each bracket means includes a horizontal section positionable flush with the lower surface of the box spring.

12. The hardware as set forth in claim 10 wherein the resilient fingers are in opposed interleafed relationship.

* * * * *

UNITED STATES PATENT AND TRADEMARK OFFICE

CERTIFICATE OF CORRECTION

PATENT NO. : 4,860,398

DATED : August 29, 1989

INVENTOR(S) : Vivian L. Karpinski

It is certified that error appears in the above—identified patent and that said Letters Patent is hereby corrected as shown below:

In Column 6, at Line 17, after "box" insert --spring upon--.

Signed and Sealed this

Twenty-third Day of October, 1990

*Attest:*

HARRY F. MANBECK, JR.

*Attesting Officer*

*Commissioner of Patents and Trademarks*